US006402937B1

(12) United States Patent
Shaffer, Jr. et al.

(10) Patent No.: US 6,402,937 B1
(45) **Date of Patent: *Jun. 11, 2002**

(54) "PUMPED" RECYCLE VAPOR

(75) Inventors: Arthur G. Shaffer, Jr., Grayson; Howard F. Moore, Ashland, both of KY (US)

(73) Assignee: Marathon Ashland Petroleum LLC, Findlay, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/575,598

(22) Filed: May 22, 2000

(51) Int. Cl.[7] ..... C10M 175/00
(52) U.S. Cl. ..... 208/179; 208/184; 208/185
(58) Field of Search ..... 208/179, 184, 208/185

(56) References Cited

U.S. PATENT DOCUMENTS 4,101,414 A 7/1978 Kim et al.
5,244,565 A 9/1993 Lankton et al.
5,302,282 A 4/1994 Kalnes et al.
5,447,628 A 9/1995 Harrison et al.
6,006,009 A * 12/1999 Friedheim ..... 342/400

* cited by examiner

*Primary Examiner*—Walter D. Griffin
*Assistant Examiner*—Tam M. Nguyen
(74) *Attorney, Agent, or Firm*—Richard D. Stone

(57) ABSTRACT

A process for the direct contact heating and vaporization of UMO is disclosed. A superheated, but condensable, vapor heats and vaporizes distillable liquid hydrocarbons from a waste motor oil stream, producing an overhead vapor fraction of injected superheated vapor and vaporized boiling range components. This material is cooled and partially condensed to produce lube boiling range liquid hydrocarbons and a vapor phase, which is condensed to produce a recycle liquid phase. Recycle liquid is pumped and then heated to produce superheated vapor for recycle to contact the UMO.

11 Claims, 1 Drawing Sheet

"PUMPED" RECYCLE VAPOR

CROSS REFERENCE TO RELATED APPLICATIONS

This invention is an improvement of the basic Used Motor Oil (UMO) process described in allowed application Ser. No. 09/026367 filed on Feb. 19, 1998, issuing May 30, 2000, now U.S. Pat. No. 6,068,759 which is incorporated herein by reference. This prior application and the application have overlapping inventors and a common assignee.

FIELD OF THE INVENTION

The invention relates to the re-refining of used motor oil.

BACKGROUND OF THE INVENTION

Extensive work has been reported in the patent literature on use of large amounts of hot, high pressure hydrogen for vaporization of used motor oil (UMO). While such processes are certainly technically feasible, there are significant capital costs associated with the relatively high pressure operation reported (typically 500 psig). Operation at high pressure makes it difficult to vaporize the used lube oil components, so higher hydrogen addition/circulation rates are used to facilitate vaporization, with hydrogen circulation rates of 10,000–18,000 SCFB being reported. Hydrogen helps suppress some condensation coking reactions that otherwise could occur in the heating and vaporization step. The hydrogen is also present in an amount sufficient to supply the hydrogen demand of a downstream hydrotreating reactor. This combination, high-pressure hydrogen coupled with downstream hydrotreating, can produce a liquid product from a UMO fraction which is excellent for use as either a lube stock or as cracker charge.

Representative hot hydrogen UMO processes are listed below:

| U.S. Pat. No. | Issue Date | Inventor | Title |
|---|---|---|---|
| 4,806,233 | 21 Feb. 1989 | James, Jr., et al. | Method Of Separating a Hot Hydrocarbonaceous Stream |
| 4,818,368 | 4 April 1989 | Kalnes, et al. | Process for Treating a Temperature-Sensitive Hydrocarbonaceous Stream Containing a Non-Component to Produce a Hydrogenated Distillable Hydrocarbonaceous Product |
| 4,840,721 | 20 June 1989 | Kalnes, et al. | Process for Treating a Temperature-Sensitive Hydrocarbonaceous Stream Containing a Non-Distillable Component to Produce a Hydrogenated Distillable Hydrocarbonaceous Product |
| 4,882,037 | 21 Nov. 1989 | Kalnes, et al. | Process for Treating a Temperature-Sensitive Hydrocarbonaceous Stream Containing a Non-Distillable Component to Produce a Selected Hydrogenated Distillable Light Hydrocarbonaceous Product |

-continued

| U.S. Pat. No. | Issue Date | Inventor | Title |
|---|---|---|---|
| 4,923,590 | 8 May 1990 | Kalnes, et al. | Process for Treating a Temperature-Sensitive Hydrocarbonaceous Stream Containing a Non-Distillable Component to Produce a Hydrogenated Distillable Hydrocarbonaceous Product |
| 4,927,520 | 22 May 1990 | Kalnes, et al. | Process for Treating a Hydrocarbonaceous Stream Containing a Non-Distillable Component to Produce a Hydrogenated Distillable Hydrocarbonaceous Product |
| 5,004,533 | 2 April 1991 | Kalnes, et al. | Process for Treating an Organic Stream Containing a Non-Distillable Component to Produce an Organic Vapor and a Solid |
| 5,013,424 | 7 May 1991 | James, Jr., et al. | Process for the Simultaneous Hydrogenation of a First Feedstock Comprising Hydrocarbonaceous Compounds and Having a Non-Distillable Component and a Second Feedstock Comprising Halogenated Organic Compounds |
| 5,028,313 | 2 July 1991 | Kalnes, et al. | Process for Treating a Temperature-Sensitive Hydrocarbonaceous Stream Containing a Non-Distillable Component to Produce a Distillable Hydrocarbonaceous Product |
| 5,068,484 | 26 Nov. 1991 | James, Jr., et al. | Process for the Hydroconversion of a Feedstock Comprising Organic Compounds Having a Tendency to Readily Form Polymer Compounds |
| 5,102,531 | 7 April 1992 | Kalnes, et al. | Process for Treating a Temperature Sensitive Hydrocarbonaceous Stream Containing a Non-Distillable Component to Produce a Distillable Hydrocarbonaceous Product |
| 5,176,816 | 5 Jan. 1993 | Lankton, et al. | Process to Produce a Hydrogenated Distillable Hydrocarbonaceous Product |
| 5,244,565 | 14 Sept. 1993 | Lankton, et al. | Integrated Process for the Production of Distillate Hydrocarbon |
| 5,302,282 | 12 April 1994 | Kalnes, et al. | Integrated Process for the Production of High Quality Lube Oil Blending Stock |
| 5,316,663 | 31 May 1994 | James, Jr. | Process for the Treatment of Halogenated Hydrocarbons |

-continued

| U.S. Pat. No. | Issue Date | Inventor | Title |
|---|---|---|---|
| 5,354,931 | 11 Oct 1994 | Jan, et al. | Process for Hydrotreating an Organic Feedstock Containing Oxygen Compounds and a Halogen Component |
| 5,384,037 | 24 Jan. 1995 | Kalnes | Integrated Process for the Production of Distillate Hydrocarbon |
| 5,401,894 | 28 Mar. 1995 | Brasier, et al. | Process for the Treatment of Halogenated Organic Feedstocks |
| 5,552,037 | 3 Sept. 1996 | Kalnes, et al. | Process for the Treatment of Two Halogenated Hydrocarbon Streams |
| 5,723,706 | 3 Mar. 1998 | Brasier, et al. | Process for the Treatment of Halogenated Organic Feedstocks |
| 5,817,288 | 6 Oct. 1998 | Bauer, et al. | Process for Treating a Non-Distillable Halogenated Organic Feed Stream |
| 5,904,838 | 18 May 1999 | Kalnes, et al. | Process for the Simultaneous Conversion of Waste Lubricating Oil and Pyrolysis Oil, Derived from Organic Waste to Produce a Synthetic Crude Oil |

While this approach is excellent in terms of product quality, the capital and operating expense of such an approach are significant.

While there has been extensive use of high pressure hydrogen for vaporization and subsequent hydrotreating of UMO, such a process has never been used for simple vaporization at relatively low, pressure.

We wanted a process that could be used to thermally process/vaporize UMO by direct injection of superheated vapor. While we wanted to inject vapor, we also wanted to reduce or even eliminate the costly recycle gas compressor.

We discovered a way to reprocess UMO in a relatively low cost and low pressure facility using direct injection of superheated vapor to heat and thermally process the UMO. We were able, by careful choice of the working fluid and process conditions, to condense much or all of the injected vapor to liquid. A relatively low cost, low energy consuming pump then increased the pressure of the condensed liquid. This high pressure liquid was then subsequently heated and vaporized to form superheated, relatively high pressure vapor for re-injection into the UMO process. We were also able, by selection of different working fluids, to reduce the amount of high-grade (high temperature) heat input required and/or reduce the end of run temperature for the UMO reactor/vaporizer.

BRIEF DESCRIPTION OF THE INVENTION

Accordingly, the present invention provides a process for direct contact heating and vaporization of UMO comprising heating and vaporizing in a UMO vaporization vessel operating at UMO vaporization conditions a liquid UMO feed by direct contact heat exchange with a recycled, superheated, vapor to produce a UMO vapor fraction comprising a mixture of vaporized lubricating oil boiling range hydrocarbons and said recycled superheated vapor and a liquid phase residue fraction; withdrawing, at least intermittently, from said vaporization vessel said residue fraction as a liquid product of said process; withdrawing from said vaporization vessel, and partially cooling and partially condensing, said UMO vapor fraction and charging same into a hot separator operating at hot separator conditions including a temperature below the boiling point of said lubricating oil boiling range hydrocarbons and above the boiling point of said recycled vapor and separating therein a liquid product phase comprising at least a majority of the lubricating oil boiling range hydrocarbons present in said UMO vapor fraction from a vapor phase comprising at least a majority of said injected, superheated vapor; withdrawing from said hot separator, and cooling and condensing, said hot separator vapor to produce a recycle liquid comprising condensed hot separator vapor condensed liquid; pumping at least a portion of said recycle liquid to increase the pressure thereof and produce a pressurized recycle liquid; heating and vaporizing said pressurized recycle liquid by indirect heat exchange or heating in a fired heater to form superheated vapor; and injecting said superheated vapor into said UMO vaporization process to vaporize by direct contact heat exchange, liquid UMO feed.

DETAILED DESCRIPTION

In our process, the used lube oil may be treated either continuously or batch-wise. There is nothing critical about the reactor/thermal vaporizer vessel used—it can be a conventional vapor/liquid contact apparatus such as a modified fractionator, a continuous stirred tank reactor, a turbulent or plug flow reactor, a Wiped Film Evaporator (WFE), or a large pot or vessel. Preferably, multiple batch reactors are used with means for injecting the superheated vapor into a pool of motor oil in each reactor. Hot UMO heating and, if desired, some decomposition of additives can occur in the lower portion of such vessels.

Preferably, the used motor oil is preheated by conventional means such as heat exchange, fired heaters or the like. The temperature of the preheated UMO should not exceed 600° F. and preferably does not exceed 500° F. and most preferably does not exceed 400° F. UMO can decompose on metal surfaces when the temperature gets above 400° F.

In a preferred process, wherein the oil is disposed in a batch vessel and contacted with superheated vapor, the vessel overhead will comprise vaporized lubricating oil boiling range components and injected superheated vapor. The overhead vapor fraction is preferably cooled to a temperature sufficient to condense most, and preferably essentially all, of the normally liquid, lubricating oil boiling range components while leaving the injected superheated vapor as a vapor. This permits a condensed, lube oil component rich fraction to be recovered as a liquid from a Hot Flash Separator (HFS). The HFS vapor, comprising 90+mole % and preferably essentially all of the injected superheated vapor, is removed as an overhead vapor fraction from the HFS. This HFS vapor is then cooled to condense at least a portion thereof, and preferably all, to form a liquid phase. This liquid is then pumped to a higher pressure, heated in a conventional fired heater or by heat exchange against some other hot process stream, and re-injected as a recycled, superheated vapor into the thermal reactors processing UMO.

Working Fluid

The "pumped" recycle vapor may aptly be called a working fluid. Suitable working fluids include LPG fractions, such as propane, propylene, butane, isobutylene, and mixtures thereof. These materials have a high heat capacity in terms of energy per mole of gas. They are readily available in a refinery or may be purchased as a staple article of commerce. A drawback to the use of, e.g., propane is that the process must either operate at a relatively high pressure (which impairs UMO vaporization in the thermal reactor/vaporizers) or with cooling water or chilled water to condense the propane vapor into liquid propane which may then be pumped.

Steam may be used, but a significant amount of water treatment may be needed to clean up the condensed, oily water sufficiently to permit its use as boiler feed water to generate superheated vapor. Use of steam will be preferred in some cases, e.g. when the UMO raw feed contains large amounts of water in excess of 1%, e.g. 5–10 or even 15 wt. % or more.

Light alcohols and ethers, which are normally liquids at room temperature, may be used with good results. These materials are cheap and readily available. Even the lightest of them, methanol, may be condensed at ambient temperature at pressures likely to be used in our preferred UMO process. Simple fin-fan coolers, or heat exchangers with cooling water, can condense methanol vapor to form liquid methanol which can be pumped to a higher pressure for re-heating and re-injection into the UMO.

It should be noted that refinery injection of methanol or methanol/stream mixtures is not, per se, novel. Methanol injection is known for use an anti-corrosion aid or as a substitute for steam stripping in a pipe still fractionating crude oil.

DETAILED DESCRIPTION OF PREFERRED EMBODIMENTS

Figure 1:
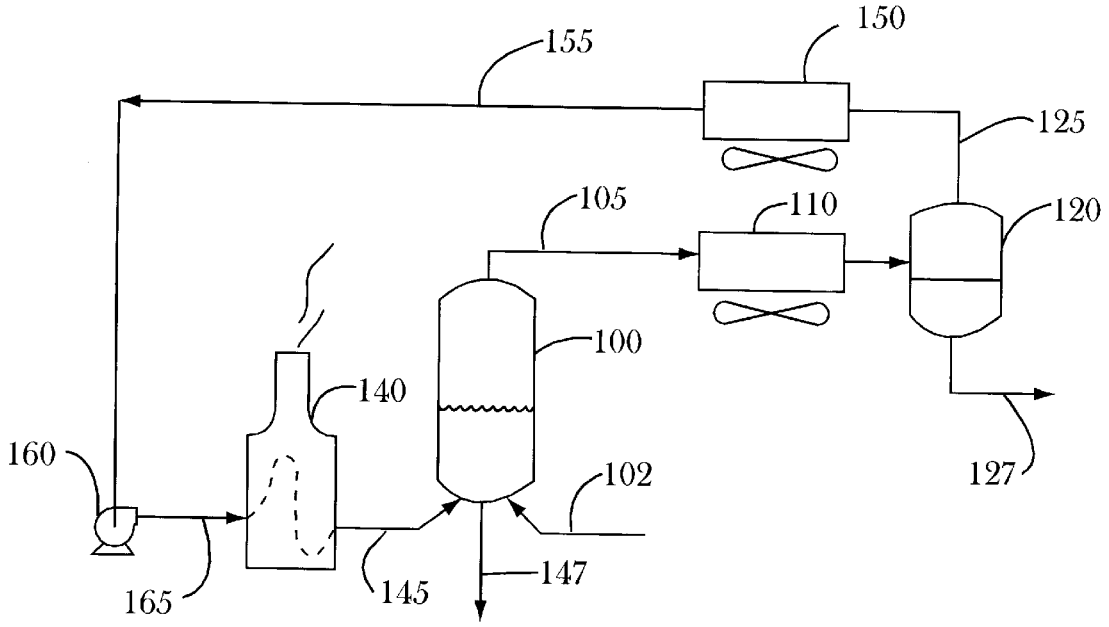
FIG. 1 is a highly simplified process flow diagram from which most pumps, flow controllers, heat exchangers, and the like have been omitted.

UMO reactor/thermal vaporizer 100 is charged, at least periodically, with UMO from line 102. The UMO is heated by direct contact heat exchange with a superheated vapor stream from line 145. Injected vapor and resulting vaporized lubricating boiling range hydrocarbons are removed via line 105 from vessel 100. These vapors are partially cooled and partially condensed in fin-fan cooler 110 and discharged into hot separator 120. Reaction conditions are adjusted so that most, and preferably essentially all, of the lubricating oil boiling range hydrocarbons condense to form a liquid phase which is removed via line 127 for use as diesel fuel, fuel oil, cat cracker charge, or reprocessing for use as UMO base stock. Withdrawn as an overhead vapor fraction from vessel 120 is a vapor stream comprising most of the injected superheated vapor, which is cooled in fin-fan cooler 150 to condense the vapor to form a liquid stream. This liquid is conveyed via line 155 to pump 160 and discharged via line 165 to pass through heater 140 to form superheated vapor for injection into vessel 100.

At least periodically a residue stream, comprising heavy polymers that may be present, additive materials and additive decomposition products, if any, and higher molecular weight lubricating oil components, is drained via line 147.

Propane Case

The embodiment using propane as the working fluid, requires the use of refrigerant or chilled water to condense the propane. The amount of chilled water or refrigerant required can be reduced, and perhaps eliminated, by operating the process at higher pressure, but higher pressures reduce vaporization of UMO, so more recycle propane or higher temperature in the furnace superheating the propane would be required.

Methanol and water are preferred working fluids for use herein.

Computer Simulation

The examples that follow are based upon computer simulations, using computer programs that have proven reliable for predicting the performance of various refinery units in the past. The computer simulations are consistent with, but not directly comparable to, a limited amount of laboratory test work done with steam. As an example of the difference between the two approaches, the computer simulation predicts an end of run thermal reactor temperature a few degrees different than an actual test result. The difference is not believed significant and probably is due to the difficulty of maintaining relatively small pilot plant size equipment at a high temperature in a cold room.

This computer simulation is reliable and is used to design refinery fractionation towers, etc. and a commercial scale UMO plant.

The computer simulations that follow are side-by-side comparisons of different working fluids and different approaches (recycling a vapor by compressing it versus once through operation or pumped recycle vapor).

In all cases, the same general process flow sequence was followed, i.e. pre-flash to remove light ends and water from UMO followed by batch vaporization in a vessel.

In all cases, hot UMO vaporizer overhead vapors were heat exchanged against the vapor charged to the reactor. This reduced the temperature of the UMO vapor from 584–675° F. (depending on the working fluid and other process conditions) to a temperature below 500° F. This cooled, but still essentially vapor phase, UMO overhead material was then heat exchanged against the UMO feed to the pre-flash. Fin-fan coolers then cooled and condensed the lubricating oil boiling range components in the UMO vaporizer overhead vapors, leaving most, and preferably essentially all, of the injected vapor in the vapor phase. Condensed hydrocarbon liquid was recovered in a hot separator operating at a temperature of 300° F. for this exercise. Hot separator liquid was then heat exchanged against incoming, ambient temperature UMO feed to provide a measure of preheat of the UMO feed prior to heat exchange of UMO feed with hot UMO vaporizer vapors.

This approach to, and amount of, heat exchange was considered a reasonable compromise for a commercial plant. Further heat savings could be achieved by adding more heat exchanger capacity, but this increased the cost and complexity of the plant. This approach did allow a fair comparison of different working fluids.

In the tables that follow, the following abbreviations have been used and are listed below with their accompanying definitions:

ULO (or UMO) Cold Feed is the filtered, raw UMO feed to the plant.

Pre-flash Drum Vapor refers to the overhead vapors from the pre-flash. The pre-flash preferably removes at least 80% of the water, chlorinated solvents, and gasoline boiling range components from the UMO feed.

Hot ULO Charge to Reactors refers to the pre-heated feed to each vaporizing vessel.

Thermal Reactor Vapor refers to the overhead vapors from each vaporizing reactor. The numbers reported are averaged over the entire heat cycle.

Residue Product refers to the bottoms fraction remaining in each vaporization reactor after completion of a heat cycle.

Gas Oil Rec.Vapor refers to the overhead vapor fraction from the hot separator or gas oil receiver. This operates at roughly 300° F. in these examples.

Gas Oil Product refers to the liquid fraction removed from the hot separator. It contains essentially all of the lubricating oil boiling range components and is similar to, and may be substituted for or blended with, gas oil charge to an FCC unit.

Oily Wastewater Product is the liquid water phase resulting when pre-flash overhead vapors and injected steam in the gas oil rec. vapor are cooled and condensed.

S.H. Steam-to-Reactors refers to the amount of Super-Heated steam (or other working fluid as the case may be) charged to each vaporization reactor during a heat cycle.

It will be beneficial if the UMO is subjected to a pre-flash, or initial heating, to remove much or all of the volatile organic chlorides and/or some or all of the gasoline boiling range components and water which may be present. This ensures that if a UMO collector brings in a bad batch of UMO, with excessive amounts of chlorinated solvent, then the chlorinated solvents will be largely removed upstream of the UMO thermal reactors/vaporizers. Use of a pre-flash will increase the capital cost of the process to some extent in requiring an isolated, overhead receiver dedicated to the pre-flash column. There is little change in operating expense because all distillable compounds, at least those distillable at temperatures below, e.g., 500° F., will be removed at some point in the process, so there is no increase in energy consumption by flashing upstream of the thermal reactor/vaporizers. An additional benefit of a pre-flash section is that

ULO REPROCESSING - METHANOL LIQUID VAPORIZING

| Stream No. | 1 | 2 | 3 | 4 | 5 | 6 | 7 | 8 | 9 | 10 |
|---|---|---|---|---|---|---|---|---|---|---|
| Stream Description | ULO Cold Feed | Preflash Drum Vapor | Hot ULO Charge to Reactors | Thermal Reactor Vapor | Residue Product | Gas Oil Rec. Vapor | Gas Oil Product | Oily Wastewater Product | Circulating MeOH | Fuel Gas Makeup |
| M3/HR | 7.29 | 888.45 | 6.59 | 2410,255.47 | 1.21 | 9,936.91 | 5.37 | 0.73 | 16.65 | 733.88 |
| KG/HR. Hydrocarbon | 5,849 | 37 | 5,813 | 17,705 | 1,163 | 13,008 | 4,698 | 58 | 13,008 | 496 |
| KG/HR. Water | 672 | 670 | 2 | 353 | 0 | 353 | 0 | 670 | 353 | 0 |
| MOL. WT. | 123.4 | 18.8 | 378.9 | 41.8 | 590.0 | 31.9 | 349.1 | 19.3 | 31.9 | 16.0 |
| MOL. HR. | 52.8 | 37.5 | 15.3 | 432.9 | 2.0 | 419.4 | 13.5 | 37.6 | 419.3 | 31.0 |
| API (sp. gr.) | 28.6 | (0.65) | 28.7 | (1.44) | 14.9 | (1.10) | 30.0 | (1.0) | (0.80) | (0.55) |
| Process Conditions | | | | | | | | | | |
| Temp ° F. | | | | | | | | | | |
| Temp ° C. | | | | | | | | | | |
| Pressure PSIG | | | | | | | | | | |

ULO REPROCESSING - PROPANE GAS VAPORIZING (REFRIGERATION OPTION)

| Stream No. | 1 | 2 | 3 | 4 | 5 | 6 | 7 | 8 | 9 | 10 | 11 |
|---|---|---|---|---|---|---|---|---|---|---|---|
| Stream Description | ULO Cold Feed | Preflash Drum Vapor | Hot ULO Charge to Reactors | Thermal Reactor Vapor | Residue Product | Gas Oil Rec. Vapor | Gas Oil Product | Oily Wastewater Product | Circulating Propane | Fuel Gas Makeup | Propane Refrig-erant |
| M3/HR | 7.29 | 888.45 | 6.59 | 7,664.47 | 1.21 | 7,362.42 | 5.41 | 0.72 | 27.10 | 377.56 | 15,535.41 |
| KG/HR. Hydrocarbon | 5,849 | 37 | 5,813 | 18,411 | 1,163 | 13,729 | 4,683 | 47 | 13,762 | 239 | 28,911 |
| KG/HR. Water | 672 | 670 | 2 | 2 | 0 | 2 | 0 | 670 | 0 | 0 | 0 |
| MOL. WT. | 123.4 | 18.8 | 378.9 | 56.9 | 590.0 | 44.2 | 366.0 | 19.1 | 44.2 | 44.1 | 44.1 |
| MOL. HR. | 52.9 | 37.5 | 15.3 | 323.5 | 2.0 | 310.8 | 12.8 | 37.6 | 311.5 | 5.4 | 655.6 |
| API (sp. gr.) | 28.6 | (0.65) | 28.7 | (1.97) | 14.9 | (1.53) | 31.7 | (1.00) | (0.508) | (0.507) | (1.52) |
| Process Conditions | | | | | | | | | | | |
| Temp ° F. | | | | | | | | | | | |
| Temp ° C. | | | | | | | | | | | |
| Pressure PSIG | | | | | | | | | | | |

Pre-Flash

Many UMO streams contain significant amounts of volatile, light components ranging from chlorinated solvents to gasoline, from crankcase dilution to unknown materials dumped in the UMO or picked up in some part of the collection process, to water.

low-grade heat may be used to pre-heat/heat the UMO to the desired pre-flash temperature. The pre-flash will typically operate at around 225° F.–500° F., preferably 250° F.–400° F., and most preferably 275° F.–350° F.

The pre-flash preferably operates at near atmospheric pressure, but may operate under vacuum, e.g. 0.1 to 1.0 atmospheres, absolute. The pre-flash may operate at somewhat higher pressures to be compatible with parts of the UMO plant, e.g. from 1 to 20 atmospheres.

What is claimed is:

1. A process for direct contact heating and vaporization of used motor oil, UMO, comprising:

a. heating and vaporizing in a UMO vaporization vessel operating at UMO vaporization conditions a liquid UMO feed by direct contact heat exchange with a recycled, superheated, vapor to produce a UMO vapor fraction comprising a mixture of vaporized lubricating oil boiling range hydrocarbons and said recycled superheated vapor and a liquid phase residue fraction;

b. withdrawing, at least intermittently, from said vaporization vessel said residue fraction as a liquid product of said process;

c. withdrawing from said vaporization vessel, and partially cooling and partially condensing, said UMO vapor fraction and charging same into a hot separator operating at hot separator conditions including a temperature below the boiling point of said lubricating oil boiling range hydrocarbons and above the boiling point of said recycled vapor and separating therein a liquid product phase comprising at least a majority of the lubricating oil boiling range hydrocarbons present in said UMO vapor fraction from a vapor phase comprising at least a majority of said injected, superheated vapor;

d. withdrawing from said hot separator, and cooling and condensing, said hot separator vapor to produce a recycle liquid comprising condensed hot separator vapor condensed liquid;

e. pumping at least a portion of said recycle liquid to increase the pressure thereof and produce a pressurized recycle liquid;

f. heating and vaporizing said pressurized recycle liquid by indirect heat exchange or heating in a fired heater to form superheated vapor; and g. injecting said superheated vapor into step a) of said UMO vaporization process to vaporize by direct contact heat exchange, liquid UMO feed.

2. The process of claim 1 wherein said recycled superheated vapor is selected from the group of propane, propylene, butane, butylene and mixtures thereof.

3. The process of claim 1 wherein said recycled superheated vapor is steam.

4. The process of claim 1 wherein said recycled superheated vapor is a normally liquid alcohol or ether.

5. The process of claim 4 wherein said recycled superheated vapor is methanol.

6. The process of claim 1 wherein at least 50 wt. % of said liquid UMO feed charged to said process is vaporized in said vaporization vessel and removed as a UMO vapor fraction.

7. The process of claim 6 wherein at least 75 wt.% of said UMO feed is vaporized.

8. The process of claim 1 wherein said recycle liquid is the source of essentially all of the superheated vapor charged to said process to vaporize said liquid UMO charge and wherein the process operates without a recycle gas compressor.

9. The process of claim 1 wherein all phases of the process operate at a pressure of 0.5–20 atmospheres, absolute.

10. The process of claim 1 wherein all phases of said process operate within a pressure range of atmospheric to 10 atmospheres, absolute.

11. The process of claim 1 wherein said pressurized recycle liquid is at least partially vaporized by indirect heat exchange against a vapor or liquid stream produced by said process to produce a pressurized, vapor phase, and said pressurized vapor phase is heated in a fired heater to produce said superheated vapor.

* * * * *